United States Patent [19]

Guntly et al.

[11] Patent Number: 5,058,544

[45] Date of Patent: Oct. 22, 1991

[54] FLOATLESS CARBURETOR WITH INTEGRAL PRIMER SYSTEM

[75] Inventors: Thomas G. Guntly, Hartford; Jerome L. Rasmussen, Germantown; Richard T. Anderson, Menomonee Falls, all of Wis.

[73] Assignee: Briggs & Stratton Corp., Milwaukee, Wis.

[21] Appl. No.: 590,014

[22] Filed: Sep. 28, 1990

[51] Int. Cl.[5] ..... F02M 1/16

[52] U.S. Cl. ..... 123/187.5 R; 261/DIG. 8

[58] Field of Search ..... 123/187.5 R, 180 P; 261/DIG. 8

[56] References Cited

U.S. PATENT DOCUMENTS

| | | | |
|---|---|---|---|
| 1,345,516 | 7/1920 | Thompson | 261/DIG. 8 |
| 3,323,293 | 6/1967 | Santi | 123/187.5 R |
| 3,415,236 | 12/1968 | Reichenbach et al. | 123/187.5 R |
| 3,494,343 | 2/1970 | Nutten | 123/187.5 R |
| 4,228,110 | 10/1980 | Magnet | 123/187.5 R |
| 4,699,739 | 10/1987 | Armes | 123/187.5 R |

*Primary Examiner*—Andrew M. Dolinar

*Attorney, Agent, or Firm*—Andrus, Sceales, Starke & Sawall

[57] ABSTRACT

A floatless carburetor with a fuel reservoir in communication with the carburetor throttle bore includes an integral primer system which is operable to introduce fuel directly into both the carburetor throttle bore and the fuel reservoir. A plurality of check valves control flow of fuel from the fuel tank into the primer system and into the throttle bore and fuel reservoir. The carburetor and primer system are adapted to be operated in conjunction with an impulse-type fuel pump, wherein the primer system is operable to manually pump fuel into the reservoir when the fuel pump is not functioning.

11 Claims, 6 Drawing Sheets

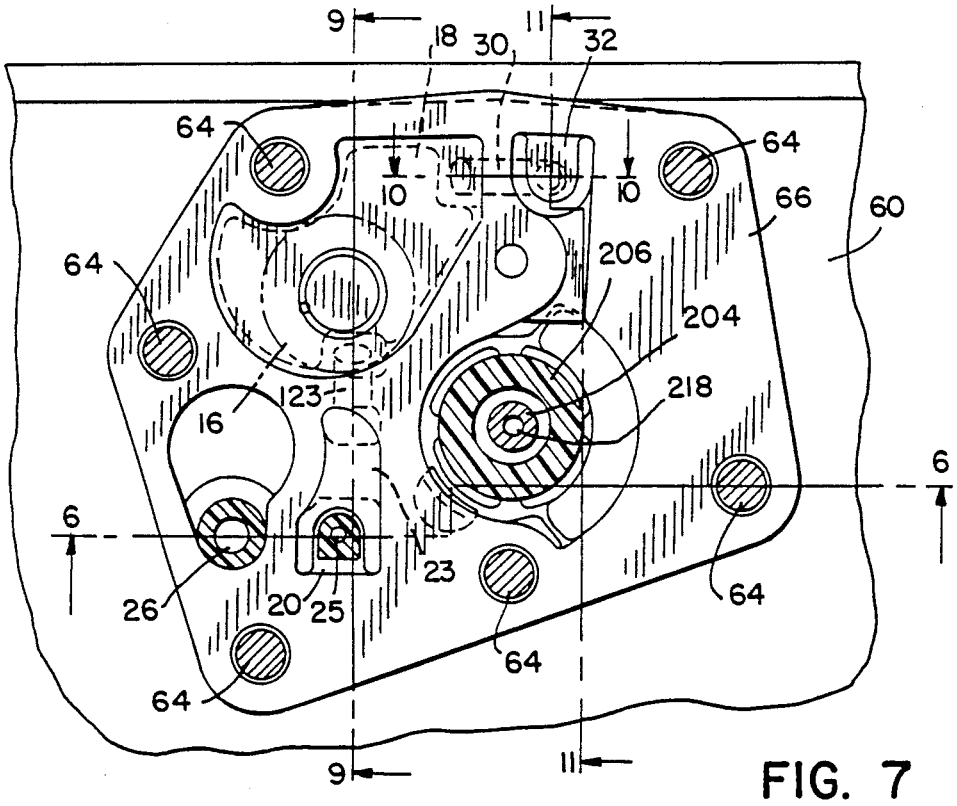
FIG. 7
FIG. 8
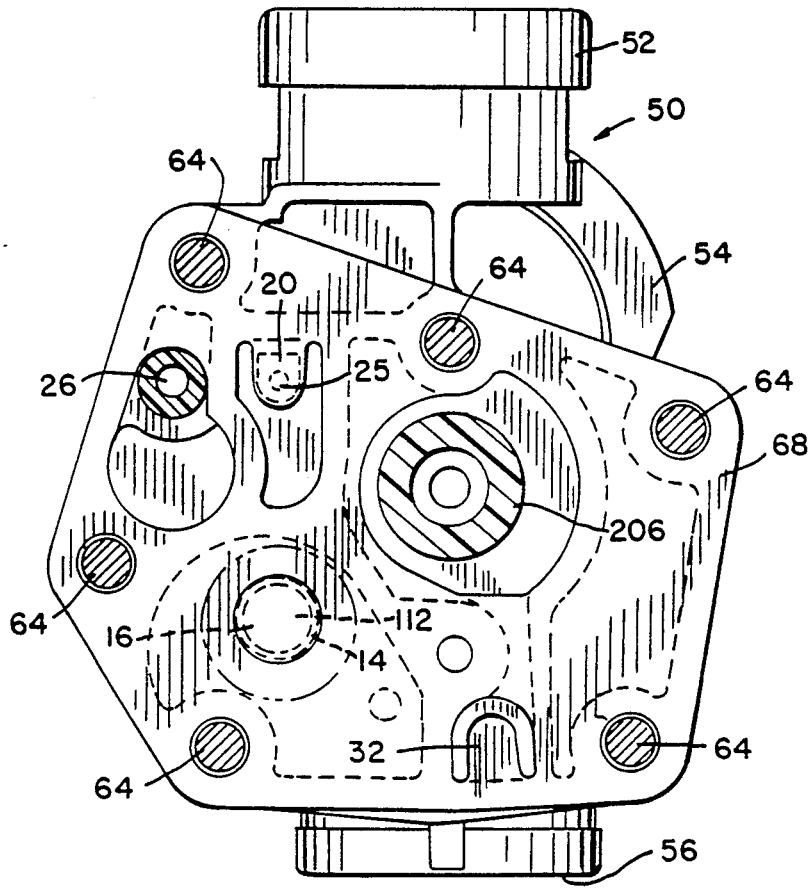

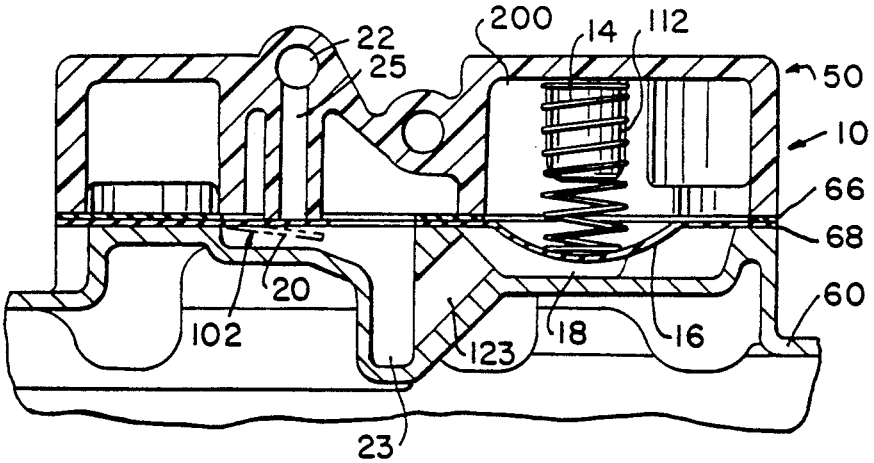
FIG. 9
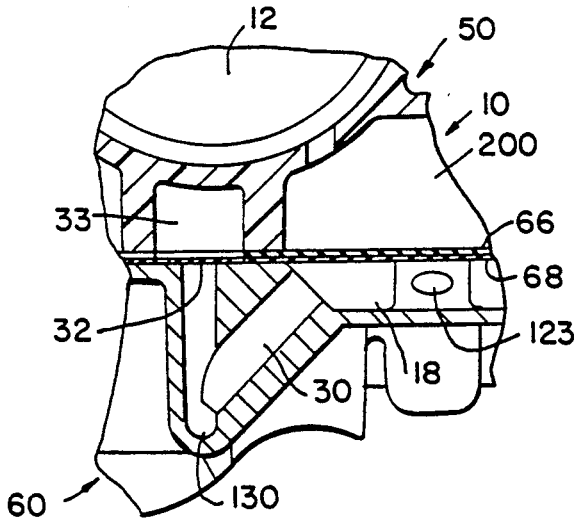
FIG. 10
FIG. 11
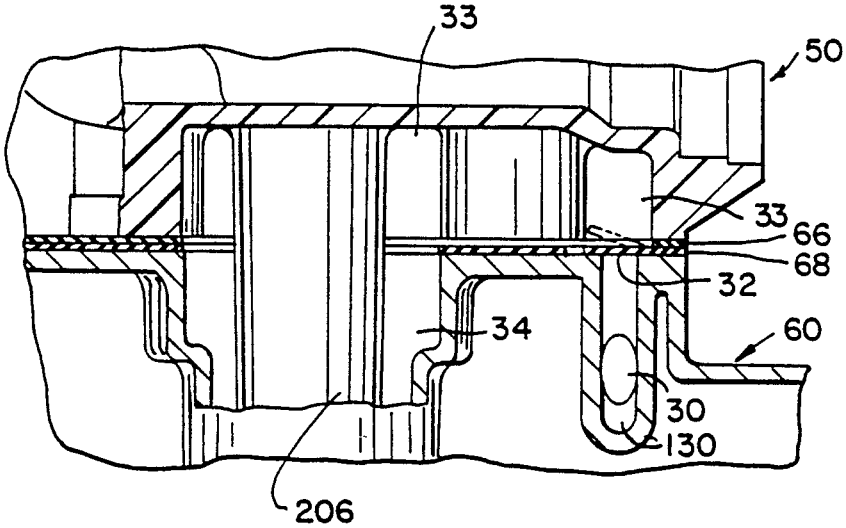

FLOATLESS CARBURETOR WITH INTEGRAL PRIMER SYSTEM

BACKGROUND OF THE INVENTION

This application is related to the application for a PRIMER BULB RETAINER FOR CARBURETOR by Thomas G. Guntly et al and assigned to a common assignee, filed on even date herewith, Serial No. 590,350, filed Sept. 28, 1990.

The subject invention is generally related to carburetors for internal combustion engines and is specifically related to a floatless carburetor equipped with an integral primer feature.

The simplest carburetor designs utilize the fuel tank as the carburetor reservoir wherein the fuel is drawn up through a tube from the fuel tank directly into a venturi via a metering orifice in the carburetor throat and from the throat directly into the engine. An example of such a carburetor can be found on the Briggs & Stratton Model 929 engine. More complex designs utilize an independent fuel feed reservoir separate from the main fuel tank, in combination with an impulse type fuel pump which reacts to the change in pressure due to the cycling of the engine to draw fuel from the main fuel tank into the reservoir. An example of this type of carburetor can be found on the Briggs & Stratton Model 929 engine. This type of design is in part, similar in function to float type carburetors where the level in a fuel feed reservoir is controlled by a float and inlet valve.

In floatless carburetors, the level in the reservoir is controlled by an overflow channel provided in the reservoir for dumping excess fuel back into the main fuel tank. The primary distinction between float type and floatless carburetors is that the float system is operative to regulate and intermittently shut off incoming fuel when the fuel level in the fuel feed reservoir is at a pre-selected level. In the floatless carburetor, the fuel pump continually pumps fuel from the tank into the fuel feed reservoir and excess fuel is dumped from the reservoir back into the tank through an overflow. Reservoir type carburetors are recognized as an advance in the art over carburetors drawing the fuel directly from the main fuel tank to the venturi because the reservoir permits the carburetor to operate on a constant fuel level system similar to float feed carburetors, whereby changes in tank fuel levels do not affect fuel metering.

Float fuel carburetors within float controlled fuel feed reservoir levels are generally considered superior in performance because of this reservoir control. However, the additional cost in the manufacture and design of float feed carburetors over floatless carburetors makes them less desirable in certain applications, particularly for small internal combustion engines. This is largely due to a combination of fuel tank, fuel hoses, fuel clamps and additional assembly required. While floatless carburetors are known and currently used, the prior art designs have not achieved the standards of performance commonly associated with float feed carburetors.

Both float feed and floatless carburetors, typically require either choking or priming prior to starting in either cool weather or after period of non-operation in order to enrich the air/fuel mixture. Typically, the carburetor and fuel delivery system includes either a choke mechanism or a primer system. On float feed carburetors, the primer generally comprises a compressible resilient bulb in communication with a closed chamber wherein depression of the bulb compresses either forcing fuel directly from the bulb or compressing air which in turn forces fuel from the chamber into the induction tract. The fuel so introduced enriches the fuel air mixture for enhancing cold starting of the engine.

The main drawback of prior art floatless reservoir concepts has been that where the reservoir of a float carburetor is always filled for immediate starting, floatless reservoirs can be empty either on initial start or after running the tank empty of fuel and restarting. In these prior art reservoir carburetors, in order to fill the reservoir, the pump must be actuated by attempting to start the engine resulting in as high as 8–10 pulls of the starter rope.

A combined carburetor and impulse fuel pump is disclosed in the U.S. Pat. No. 4,168,288 to Nau et al issued Sept. 18, 1979. A float type carburetor with an integral primer system is disclosed in the following U.S. patents all issued to Guntly or Guntly et al: U.S. Pat. Nos. 4,679,534 issued July 14, 1987; 4,684,484 issued Aug. 4, 1987 and 4,735,751 issued Apr. 5, 1988. An example of a conventional float type carburetor with an integral priming system is disclosed in the Altenbach U.S. Pat. No. 4,197,825 issued Apr. 15, 1980.

SUMMARY OF THE INVENTION

The present invention incorporates the improved performance features of a float feed type carburetor with the desirable cost advantages of a floatless carburetor to provide a superior carburetor system having operating characteristics similar to known float feed carburetors with the simplicity and cost advantages of floatless carburetor systems. The carburetor includes an integral impulse pump for drawing fuel from the fuel tank and directing it into the floatless reservoir and an integral priming system which can not only be used to prime the carburetor during cold starting, but also to fill the carburetor reservoir in lieu of the impulse pump when the engine is not cycling. This feature enhances cold or dry starting of the engine, assuring the engine will readily start even when the reservoir is initially dry. Using the primer system of the preferred embodiment, quick starts can be assured even with new engines or even after the fuel tank is run completely dry. The primer assembly permits manual introduction of fuel into the carburetor reservoir without cranking the engine while providing the typical choking function of known primer systems.

The dual function primer operation is accomplished by providing a series of one way check valves in communication with the primer, the fuel pickup, the impulse pumping chamber and the fuel reservoir. When the primer chamber is compressed by depressing the primer bulb, the increase in pressure in the primer chamber is operative to close a one way check valve in the fuel pickup line, preventing fuel from leaving the chamber and returning to the fuel tank. At the same time, a second one way check valve is open to the carburetor reservoir to introduce fuel in the primer chamber into the reservoir. In parallel with this check valve is the primer choke check valve which simultaneously is opened to introduce fuel directly into the carburetor throttle bore. When the primer bulb is released, and the primer chamber expands, the check valves in communication with the fuel reservoir are closed along with the choke check valve, and the fuel pickup check valve is opened to draw fuel into the primer chamber. With this design, the entire fuel system is full and ready for immediate operation.

In the preferred embodiment, an impulse pump is inserted in the circuit in the series between the fuel reservoir and the primer chamber. When the check valves between the primer chamber and the fuel reservoir are opened, fuel flows from the primer chamber through the check valves and through the pump chamber into the fuel reservoir. When the engine is cranking and in its intake stroke, it generates a negative pressure on the pump diaphragm and the pump is operative to draw fuel through the check valves in the pickup tubes. When the engine is in its compression stroke, and the pump diaphragm is extended, the pump chamber is compressed, closing the check valves in advance of the pump precluding flow of fuel from the chamber back into the tank, while at the same time opening the check valve between the pump and the reservoir to release fuel from the pump chamber into the carburetor reservoir.

It is, therefore, an object of the present invention to provide a floatless carburetor having operating characteristics similar to known float feed type carburetors.

It is a further object of the present invention to provide for a primer system in association with a floatless carburetor which functions not only to prime the carburetor by releasing fuel directly into the throttle bore, but also to be operative to manually pump fuel into the carburetor fuel reservoir filling the entire fuel circuitry without use of the fuel pump when the fuel pump is in a non-operating condition.

It is yet another object of the present invention to provide for a floatless carburetor in combination with an integrated primer system and a fuel pump having operating features and characteristics similar to more expensive and complex float feed type carburetor systems.

Other objects and features of the invention will be readily apparent from the drawing and description of the preferred embodiment which follow.

BRIEF DESCRIPTION OF THE DRAWINGS

FIG. 7 is a section view looking downward toward the fuel tank of the assembly and is taken generally along the line 7—7 of FIG. 6.

FIG. 8 is a section view looking upward toward the carburetor and is taken generally along line 8—8 of FIG. 6.

FIG. 9 is a section view taken generally along line 9—9 of FIG. 7.

FIG. 10 is a partial section view taken generally along line 10—10 of FIG. 7.

FIG. 11 is a section view taken generally along line 11—11 of FIG. 7.

DESCRIPTION OF THE PREFERRED EMBODIMENT

Figure 1:
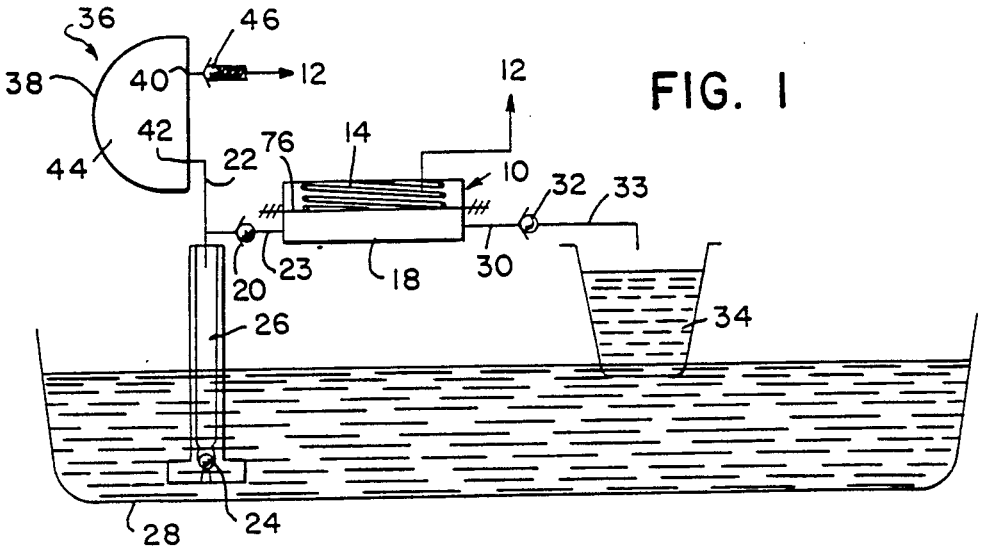
FIG. 1 is a circuit flow diagram for the floatless carburetor and primer circuit of the subject invention.

A diagramatic illustration of the flow circuitry of the preferred embodiment is shown in FIG. 1. As there shown, the priming circuit is specifically suited for use with a floatless carburetor of the type having an impulse fuel pump 10 which is in direct communication with the throttle bore 12 of the carburetor. As is well known, a biasing element such as compression spring 14 holds the pump diaphragm 16 in the fixed position. When the engine is in the intake stroke mode, and a draw is placed on the carburetor, the resulting negative pressure in the throttle bore 12 acts against the force of the compression spring 14 to pull the diagraphm 16 up as shown, to expand the pump chamber 18. This expansion pulls open the check valve 20 in the fuel line 22 and the check valve 24 in the fuel pickup tube 26, drawing fuel from the fuel tank 28 into the pump chamber 18. When the engine is in the compression stroke, and the negative pressure in the throttle bore is at near atmospheric or slightly positive pressure the pump diaphragm 16 is urged down by the compression spring, contracting the pump chamber 18 and forcing fuel through the reservoir fuel line 30 to open the check valve 32 and dispense fuel into the reservoir 34 of the floatless carburetor. Fuel is drawn from the reservoir into the throttle bore in the manner well known. The back pressure in the fuel line 23 closes valve 20 to preclude fuel flow back into tank during the compression and exhaust strokes.

The primer system 36 of the subject invention is a wet primer and is in direct communication with the fuel supply via the fuel line 22 and the pickup tube 26. As diagramatically shown in FIG. 1, the primer system includes a primer bulb 38, an orifice 40 and a fuel orifice 42. Initially when the primer bulb is closed to contract the primer chamber 44, the increase in pressure opens the check valve 46 and the pump check valve 20, while closing the pickup tube check valve 24. When the primer bulb 38 is released to expand the chamber 44, check valves 20 and 46 are closed and check valve 24 is opened, drawing fuel into the pickup tube 26, into the fuel line 22 and into the primer chamber 44. When the bulb is next depressed, valve 24 closes, and valves 20 and 46 open, releasing the fuel from the primer chamber into the throttle bore 12 via the orifice 40 and check valve 46. The fuel in the primer chamber is also forced back through the fuel port 42 and into fuel line 22, to open the check valve 20 and introduce fuel from the primer chamber into the pump chamber 18, and from the pump chamber 18 through the reservoir line 30 and check valve 32 into the reservoir 34. The back pressure on the pickup tube in this phase closes the pickup tube check valve 24. In this manner, the primer system can be used to both directly enrich the air fuel mixture in the carburetor throttle bore 12 and also to fill the reservoir 34 to enhance cold starting.

It will be noted that the circuit is operative without the inclusion of valve 20. In the preferred embodiment, valve 20 assures there is a minimum risk of back flow from the pump 10 into the primer chamber 44 when the pump is operating.

Figure 2:
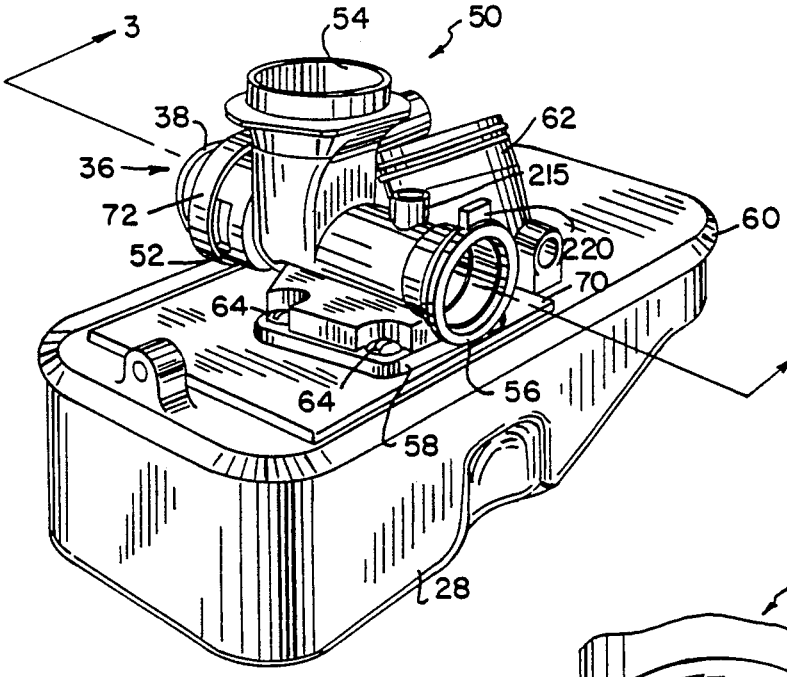
FIG. 2 is a perspective view of the carburetor, fuel tank top and fuel tank assembly of the preferred embodiment.
Figure 4:
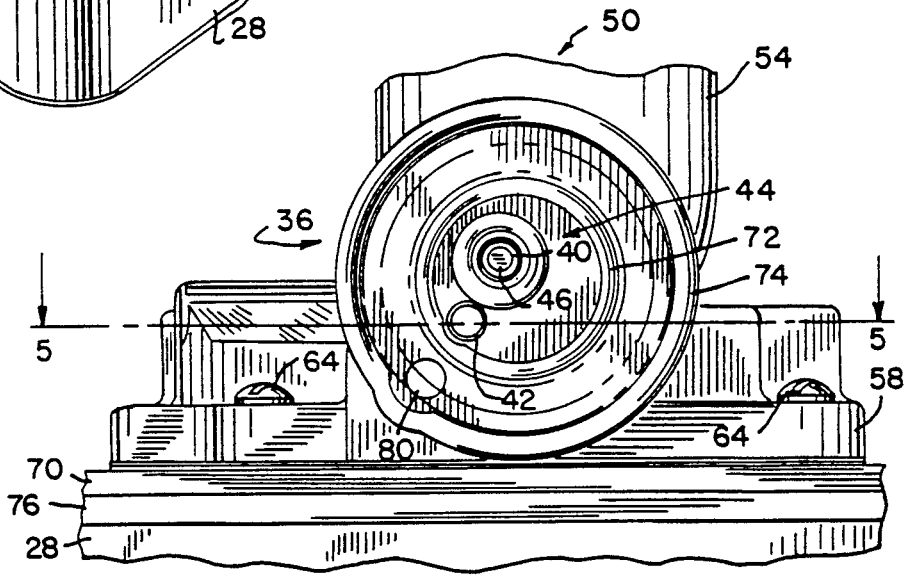
FIG. 4 is a view of the primer chamber taken generally along the line 4—4 of FIG. 3, with the primer bulb removed.
Figure 3:
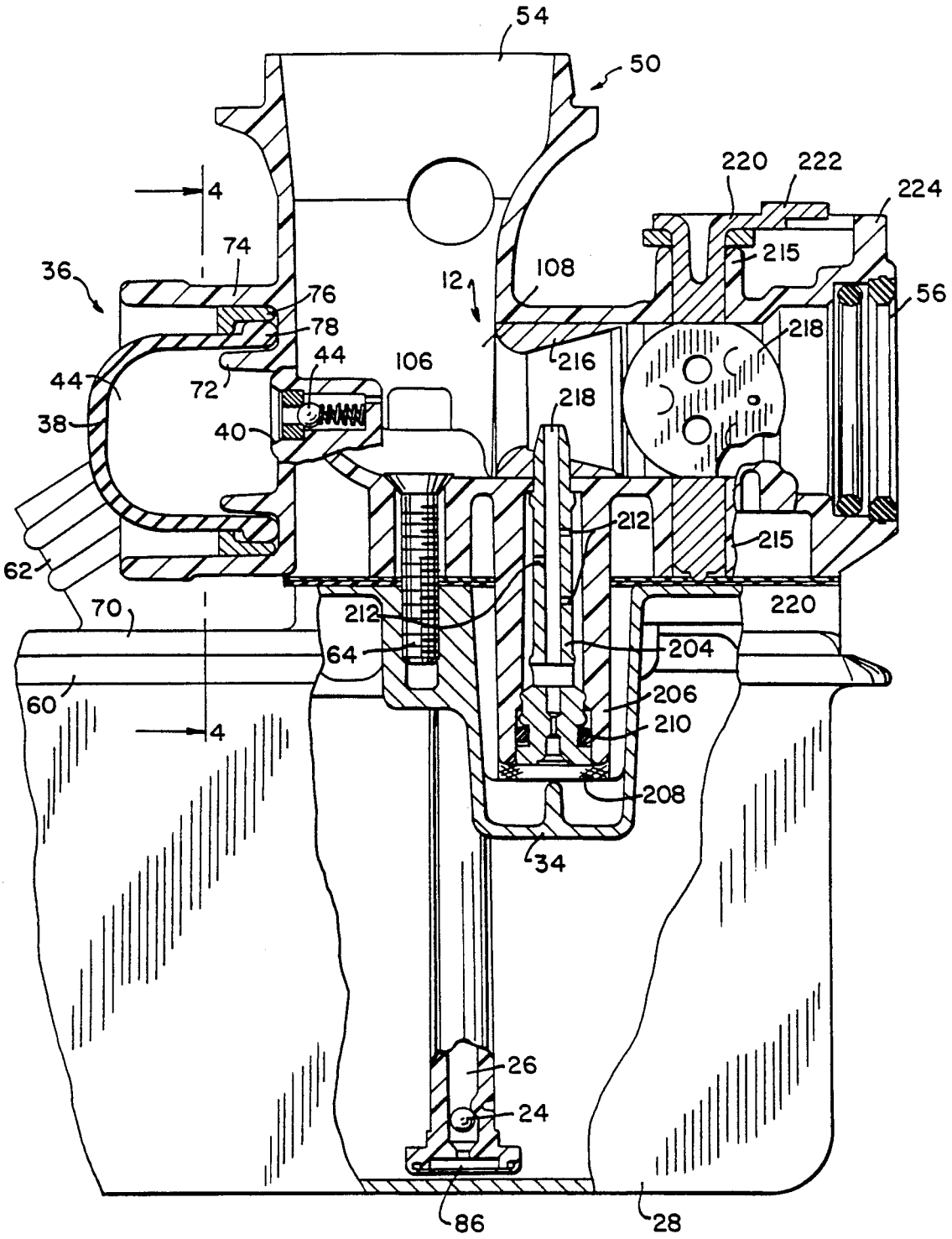
FIG. 3 is a view, partially in section, taken generally along the line 3—3 of FIG. 2.
Figure 5:
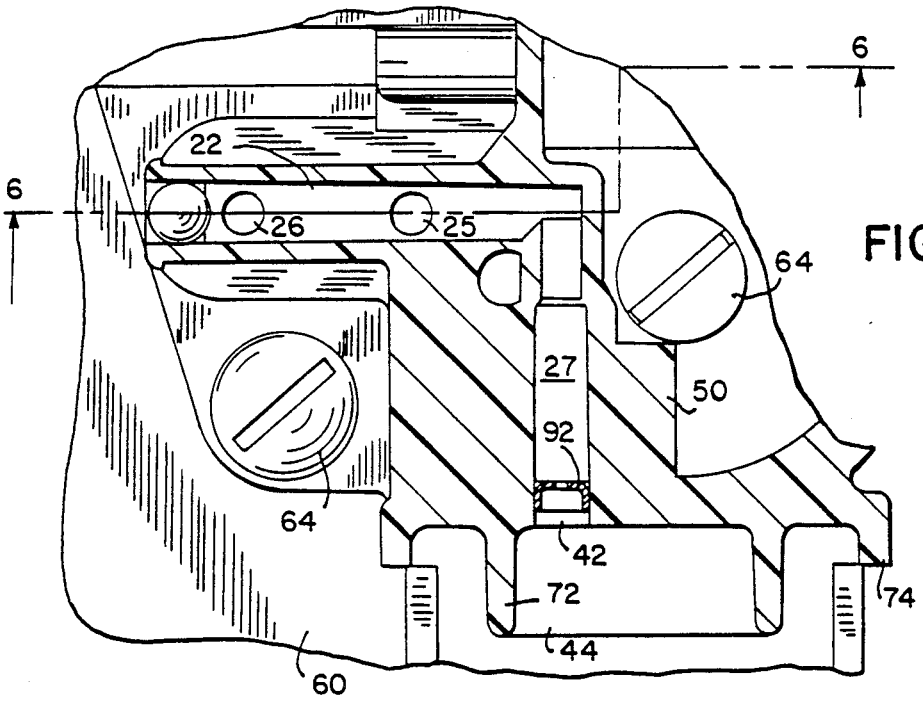
FIG. 5 shows the fuel passageways from the fuel tank to the primer chamber and is taken generally along the line 5—5 of FIG. 4.
Figure 6:
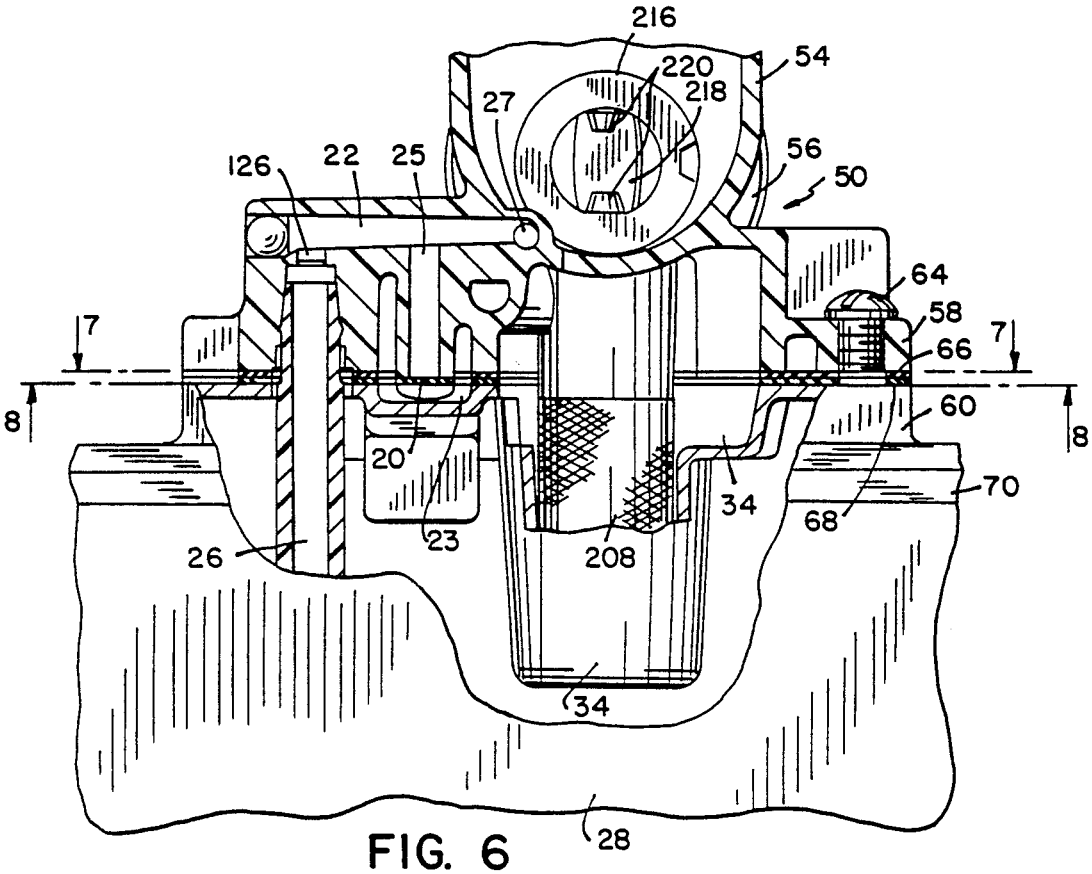
FIG. 6 is a section view taken generally along line 6—6 of FIGS. 5 and 7.

The invention as depicted in the preferred embodiment of FIGS. 2–12 is best understood if the various circuit components in FIG. 1 are correlated to the remaining drawing figures. The primer assembly 36 and primer bulb 38 are shown in FIGS. 2 and 3. The primer chamber 44 is shown in FIG. 4 with the orifice 40 and the fuel orifice 42 clearly in view. The fuel line 22 connecting the primer chamber 44 with the pickup tube 26 is best shown in FIGS. 5 and 6 and includes additional core passageways 25 and 27, as clearly shown in FIG. 5. The check valve 20 comprises the reed valve portion of the diaphragm 68, shown in FIG. 12. The check valve 20 is shown in assembled relationship with the carburetor and fuel tank in FIGS. 6, 7, 8 and 9, and is in communication with the core passage 25 and the pump passage 23 which includes the additional core passageway 123, shown in FIGS. 9 and 10. The impulse pump 10 is best shown in FIG. 9 and includes the spring 14 mounted in the carburetor spring chamber 200. The pump chamber 18 is included in the fuel tank top 50. The pump diaphragm 16 is a portion of the diaphragm assembly 68 shown in FIG. 12. The pump exit passage 30 is best shown in FIG. 7 and is in communication with the check valve 32 which defined by the reed valve 32 portion of the diaphragm 68 shown in FIG. 12. The passage 33 for communicating the check valve 32 with the reservoir 34 is best shown in FIGS. 10 and 11.

Turning now to FIG. 2, the floatless carburetor 50 of the preferred embodiment is of an integral unitary design including a base 52 for the primer assembly 36, an air intake tube 54, and an induction or outlet tube 56 all mounted on a carburetor base 58 which is secured to the tank top 60 via a plurality of mounting screws 64 or the like. The tank top 60 is also of a molded, integral design and includes an integral fill tube 62. The entire fuel delivery system of the preferred embodiment is self contained in the carburetor 50 and the fuel tank top 60, with gasket 66 and diaphragm 68.

Figure 12:
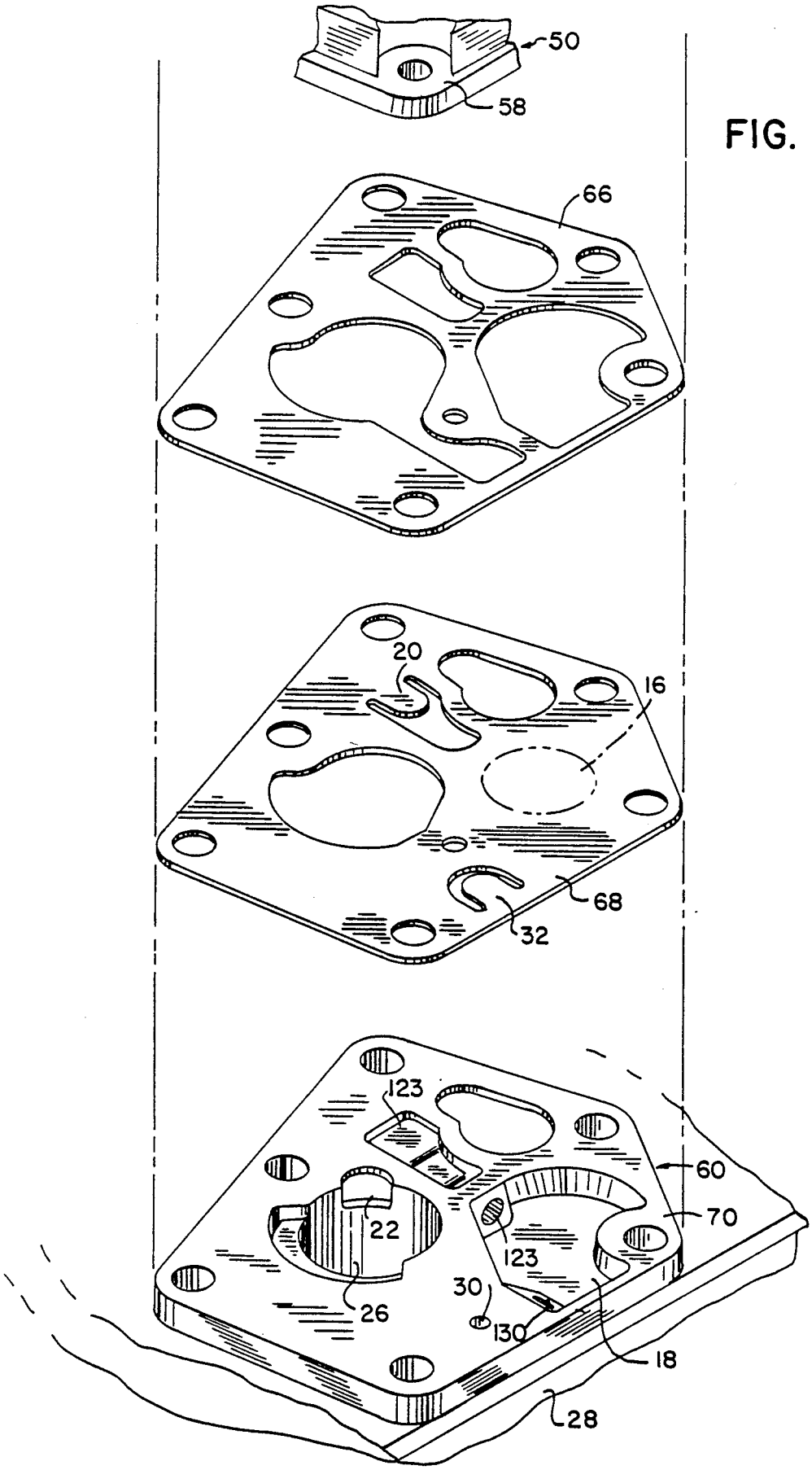
FIG. 12 is an exploded view showing the fuel tank, fuel tank top, pump diaphragm, gasket and carburetor of the assembly of FIG. 2.

In the preferred embodiment, the carburetor 50 is mounted on the tank top 60 with the gasket 66 and diaphragm 68 (FIGS. 3 and 12) placed between the carburetor base 58 and the mounting boss 70 provided on the tank top 60 (FIGS. 3, 6, and 12). The gasket and diaphragm form a tight seal between the carburetor and fuel tank to eliminate any leakage.

The primer assembly 36 includes the domed, resilient primer bulb 38 which is mounted on a sealing wall 72 (FIGS. 3 and 4) provided on the carburetor primer base 52. The outer wall 74 defines a shroud for protecting the bulb against damage, exposing only the domed end thereof. A retainer ring 76 (FIG. 3) is inserted in the channel between the inner wall 72 and the outer wall 74 to securely retain the primer bulb in place and to provide a circumferential seal against the enlarged lip or integral o-ring 78 of the bulb, providing an annular seal between the bulb and the carburetor for defining the primer chamber 44. As shown in FIG. 4, the primer chamber 44 is in communication with the carburetor throat at orifice 40 and is in communication with the fuel tank through fuel orifice 42. An air bleed passage 80 is provided in the channel between the inner wall 72 and the outer wall 74 of the primer base 52.

With reference to FIG. 6, a fuel pickup tube 26 is press fit into the carburetor base 58 and extends through the tank top 60 to the bottom of the fuel tank 28 (FIG. 3). The hollow interior of the tube 26 is in communication with the fuel line 22 via an intersecting core passage 126 (FIG. 6) provided in the carburetor. The open lower end 86 (FIG. 3) of the tube 26 includes the ball check valve 24 to maintain one way flow in the tube. The core passageway which defines the fuel line 22 is in direct communication with the intersecting core passageway 27 which leads directly to the fuel orifice 42 of the primer base (FIG. 5). As best shown in FIG. 5, a restrictor 92 is secured in the core passage 27 to restrict the flow through the primer orifice 42, providing a balanced flow between the choke orifice 40 and the fuel orifice 42 when the primer bulb is depressed to release fuel from the primer chamber.

Turning to FIGS. 9, 10, 11 and 12, the gasket 66 and diaphragm 68 are designed to provide not only the seal between the carburetor 50 and the fuel tank top 60, but also to provide a membrane area defining the pump diaphragm 16 and a pair of reed flaps defining the check valves 20 and 32. In the preferred embodiment, the gasket 66 is made of non-asbestos material or the like and the diaphragm 68 is a rubber coated fabric or the like. The gasket and diaphragm are secured in contact with one another on all mated surface areas to define a tight, leak-proof seal between the carburetor 50 and fuel tank top 60.

When assembled as shown in FIGS. 9, 10 and 11, the reed valve 20 is in communication with the carburetor core passage 25 and the chamber 23 and core passage 123 of the fuel tank top, defining the fuel pathway between the reed valve 20 and the pump chamber 18. The reed valve 20 is normally in a flat, generally closed position.

Once the primer chamber 44 is filled with fuel and the primer bulb 38 is depressed, fuel is introduced into the orifice 40 to crack the pressure seal on the ball valve 46 and displace fuel via the orifice 106 provided in the carburetor into the carburetor barrel 108 (see FIG. 3). At the same time, fuel is displaced from the primer chamber 44 back through the fuel port 42 and restrictor 92 through core passageways 27 and 22. The back pressure thus created closes the check valve 24 at the end of tube 26 and the fuel is introduced into the core passage 25. The pressurized fuel flow opens the reed valve 20 and introducing fuel into the chamber 23 (FIG. 6) of the fuel tank top 60. As shown in FIG. 9, the chamber 23 is in communication with a core passageway 123 in the fuel tank top, whereby the fuel is introduced into the pump chamber 18. As shown in FIG. 7, when the pump chamber 18 is full, the fuel is exited through core passage 30 in the fuel tank top 60 to force open the reed check valve 32. As best shown in FIGS. 10 and 11, as the fuel flows from passageway 123 into chamber 18 and is exited through core passage 30 into an intersecting core passageway 130, it forces the reed valve 32 upward and open into the chamber 33 provided in the carburetor 50. Chamber 33 is open to reservoir 34, whereby the fuel in chamber 33 is exited into the reservoir. In this manner, the primer assembly is used not only to provide a direct priming charge through the orifice 40 into the barrel of the carburetor, but also to fill the reservoir 34 to assure starting.

With reference to FIGS. 3 and 9, the diaphragm 16 of the impulse pump 10 is normally biased in the extended position by means such as the compression spring 14 which is mounted on an integral post 112 provided in the body of the carburetor. When so biased, the diaphragm contracts the size of the pump cavity 18 which is provided as an integral chamber in the tank top 60.

The reed check valves 20 and 32 are in communication with the pump chamber 18, as previously described. When the pump diaphragm 16 is withdrawn toward the carburetor 58 to expand the cavity, the reed valve 20 is pulled open and the check valve 24 in the fill tube 26 is pulled open to draw fuel from the fuel tank 28 into the pump cavity. At the same time, the reed valve 32 is pulled downward (see FIG. 11) and closed. When the diaphragm 16 is extended to contract the chamber 18, the back pressure closes reed valve 20 and prohibits fuel from reentering the core passage 25 (FIG. 9). At the same time, the positive pressure thus created, urges check valve 32 upward and open, introducing fuel into the chamber 33 in the carburetor from which it is released into the reservoir 34. In operation, when the engine is in its intake stroke mode, a negative pressure is created in the carburetor. This is communicated to the spring chamber 200 (FIGS. 9 and 10) via the orifice 202 between the spring chamber and the throttle bore 12 of the carburetor. The negative pressure overcomes the compression force of spring 112 and draws the diaphragm up toward the carburetor to expand pump chamber 18 and draw fuel from the fuel tank into the pump chamber. When the engine is in its compression stroke, a near atmospheric to slightly positive pressure is created in the throttle bore 12 and this is translated into the spring chamber 200 via the orifice 202 to push, in combination with spring 112, the diaphragm 16 to its fully extended position to contract chamber 18 and force fuel through check valve 32 and chamber 33 into the reservoir 34. Whenever the engine is running, the impulse pump 10 is operative to pump fuel from the fuel tank 28 into the reservoir 34.

As shown in FIGS. 3, 6, 7 and 11, a stem assembly 204 is mounted in an integral sleeve 206 provided in the carburetor. When assembled, the sleeve and stem extend down into the reservoir 34. A fine mesh screen 208 is provided over the open lower end of the sleeve 206 and serves as a fuel filter. The nozzle 204 is a standard fuel jet such as those commonly used in float feed carburetors and known in the art. The nozzle is sealed in the sleeve by a typical o-ring seal 210. The jet is of a smaller diameter than the inside diameter of the stem sleeve with the space between the sleeve and the outer surface of the jet being open to air. A plurality of air orifices 212 communicate the jet passage 214 with the air in the space between the sleeve and the jet to provide a balanced, pre-selected atomized air fuel mixture when the fuel in the jet is drawn into the carburetor venturi by a negative pressure during an engine intake stroke.

A venturi tube 216 is placed between the air intake tube 54 and the induction tube 56 of the carburetor 50. The jet opening 214 is disposed outboard of the narrowest restriction of the venturi, whereby the fuel released from the jet and the air being introduced via the air intake tube 54 are accelerated and atomized prior to being introduced into the throttle chamber 12.

As is best shown in FIGS. 2, 3 and 6, the outlet or induction tube 56 of the carburetor includes a pair of axially aligned mounting bosses 215 with apertures therethrough for receiving a throttle shaft 220. A standard throttle plate 218 is mounted on the shaft 220 to selectively control the size of the opening in the throttle bore 12 in advance of the induction tube 56. In the preferred embodiment, an integral stop 224 is provided on the outer end of the induction tube 56 to restrict the rotational movement of the throttle shaft 220 by providing a positive stop for the shaft radial extension 222.

While certain objectives and features have been described herein, it will be readily understood that the invention encompasses all of the enhancements and modifications within the spirit and scope of the following claims.

What is claimed is:

1. A primer circuit for a carburetor for an internal combustion engine, the carburetor of the type having an air intake, a throttle chamber, an induction chamber, and a fuel reservoir from which fuel is drawn into the throttle chamber where it is mixed with air introduced at the air intake and released into the induction chamber to support combustion in the engine, the fuel reservoir of the carburetor being in direct communication with a fuel tank, the primer circuit comprising:

a. an expandable/contractable primer chamber;

b. means communicating the primer chamber with the fuel tank;

c. means communicating the primer chamber with both the throttle chamber and the fuel reservoir of the carburetor;

d. first valve means between the fuel tank and the primer chamber and selectively movable between an open position when the primer chamber is expanded and a closed position when the primer chamber is contracted;

e. second valve means between the throttle chamber and the primer chamber and selectively movable between an open position when the primer chamber is contracted and a closed positon when the primer chamber is expanded; and f. third valve means between the fuel reservoir and the primer chamber and selectively movable between an open position when the primer chamber is contracted and a closed position when the primer chamber is expanded.

2. The primer circuit of claim 1, wherein the carburetor further includes a fuel pump in direct communication with the fuel tank and the reservoir and responsive to alternately draw fuel from the fuel tank and introduce it into the reservoir, said third valve means of the primer circuit being located between the primer curcuit and the pump and movable between the opened position when the pump is drawing fuel from the fuel tank, and the closed position when the pump is introducing fuel into the reservoir.

3. The primer circuit of claim 2, further including fourth valve means between the fuel pump and the reservoir and selectively movable between a closed position when said pump is drawing fuel from the fuel tank and an opened position when said pump is not drawing fuel from the fuel pump.

4. The primer circuit of claim 3, said fourth valve means further movable to the open position when said primer chamber is contracted.

5. The primer circuit of claim 2, said fuel pump comprising an impulse type pump responsive to engine cycling between negative and positive pressure strokes to draw fuel from the fuel tank when under negative pressure and to introduce fuel in the reservoir when under positive pressure.

6. A carburetor and primer assembly for delivering fuel from a fuel tank to an internal combustion engine, comprising:

a. carburetor body including a base, a primer chamber, an air intake port, a throttle chamber and an outlet;

b. a fuel tank adapter secured to the carburetor base and including a fuel reservoir in communication with both the carburetor throttle chamber and the primer chamber;

c. first means associated with the fuel tank for drawing fuel from the fuel tank directly into the primer chamber; and d. second means associated with the fuel tank for drawing fuel from the fuel tank directly into the reservoir.

7. The carburetor and primer assembly of claim 6, further including a diaphragm between the carburetor body and the fuel tank body, said diaphragm comprising both of said first and second means for drawing fuel from the fuel tank.

8. The carburetor and primer assembly of claim 7, wherein said second means comprises an impulse pump, and wherein the carburetor body includes a pump driving chamber on one side of the diaphragm and in communication with the outlet and the fuel tank top includes pump chamber on the other side of the diaphragm and in communication with the fuel tank and the reservoir.

9. The carburetor and primer assembly of claim 8, the diaphragm further including portions selectively movable between open and closed positions for defining a pair of valves, the first valve being positioned between the pump and the fuel tank and the second valve being positioned between the pump and the reservoir, said first valve in an open position and said second valve in a closed position when said pump is operable to draw fuel from the fuel tank into the pump chamber, and said first valve in a closed position and said second valve in an open position when said pump is operable to introduce fuel from the pump chamber into the fuel reservoir.

10. The carburetor and primer assembly of claim 9, wherein the carburetor body includes means for communicating the primer chamber with the first valve, whereby fuel can be released from the primer chamber directly into the pump chamber when said first valve is in the open position.

11. The carburetor and primer assembly of claim 10, wherein the second means associated for drawing fuel from the fuel tank includes a valve selectively movable between an open position when fuel is being drawn from the fuel tank into the primer chamber and a closed position when fuel is being released from the primer chamber.

* * * * *